US007571727B2

(12) United States Patent
Croll

(10) Patent No.: US 7,571,727 B2
(45) Date of Patent: Aug. 11, 2009

(54) MOLDED FOAM MOUTHGUARD

(76) Inventor: Theodore P Croll, 4242 Mechanicsville Rd., Mechanicsville, PA (US) 18934

( * ) Notice: Subject to any disclaimer, the term of this patent is extended or adjusted under 35 U.S.C. 154(b) by 167 days.

(21) Appl. No.: 11/163,146

(22) Filed: Oct. 6, 2005

(65) Prior Publication Data

US 2007/0079835 A1 Apr. 12, 2007

(51) Int. Cl.

| | |
|---|---|
| ***A61C 5/14*** | (2006.01) |
| ***A61F 13/00*** | (2006.01) |
| ***A61C 3/00*** | (2006.01) |
| ***A61C 19/00*** | (2006.01) |

(52) U.S. Cl. ..... 128/859; 128/848; 128/860; 128/861; 128/862; 602/902; 433/6; 433/36; 433/37; 433/38; 433/39; 424/49; 424/422; 424/435; 264/16

(58) Field of Classification Search ..... 128/848, 128/859–862; 433/6, 36–39; 602/902; 424/49, 424/422, 435; 264/16

See application file for complete search history.

(56) References Cited

U.S. PATENT DOCUMENTS

| | | | | |
|---|---|---|---|---|
| 4,773,853 | A * | 9/1988 | Kussick | 433/6 |
| 5,447,168 | A * | 9/1995 | Bancroft | 128/859 |
| 5,692,523 | A * | 12/1997 | Croll et al. | 128/859 |
| 6,820,623 | B2 | 11/2004 | Cook | |
| 2003/0150450 | A1 * | 8/2003 | Fitton | 128/200.24 |
| 2006/0112962 | A1 * | 6/2006 | Tebbutt et al. | 128/206.29 |
| 2007/0131232 | A1 * | 6/2007 | Bancroft | 128/861 |

* cited by examiner

*Primary Examiner*—Patricia Bianco
*Assistant Examiner*—Tarla R Patel
(74) *Attorney, Agent, or Firm*—Gregory J. Gore

(57) ABSTRACT

A mouthguard includes two sections, a vertical component and a horizontal component. The foam is molded into a configuration such that the vertical component curves around the anterior section of the maxillary dental arch to the lateral aspects, just beyond the canine teeth. At the mouth temperature of 98.6 degrees F., the vertical component is held perfectly between the upper lip and teeth by the general pressure of lip musculature. There is a V-shaped notch in the midline of the vertical section to accommodate the maxillary labial frenum. The horizontal component provides a bite platform and a slit is located along the midline forming two rearwardly extending tabs to facilitate the curvature of the bite platform. Accommodative curvature of the vertical section is provided by spaces between the horizontal component and the ends of the vertical component forming deflectable wings in these regions.

9 Claims, 1 Drawing Sheet

MOLDED FOAM MOUTHGUARD

FIELD OF THE INVENTION

This invention relates to dental mouthguards more particularly of the type worn by athletes in contact sports to protect their teeth.

BACKGROUND OF THE INVENTION AND PRIOR ART

It is well known for athletes to wear a mouthguard to protect their teeth from sharp blows and to protect the head and temporomandibular joint from concussion. Mouthguards are commonly worn in football, hockey, soccer, rugby, etc. There is also a need for athletes to wear mouthguard-type appliances to prevent the clenching of their teeth during physical exertion. Clenching can result in headaches, muscle spasms, damage to the teeth, and injury to the temporomandibular joint as well as pain in the jaw.

Dental mouthguards have been made from ethylene vinyl acetate (EVA) which can degrade due to use and will become deformed and decompose over time. There is also known the use of a low density polyethylene polymer preferably combined with a tactifier resin such as disclosed in U.S. Pat. No. 6,820,623 issued to Cook. The present inventor has also previously devised a two-piece mouthguard composed of separate pieces of flat, cushioning material made from polyolefin foam as described in U.S. Pat. No. 5,692,523. The disadvantage of this mouthguard is its required assembly which is inherently more complex than a single piece mouthguard.

There is therefore a need in the art for a single piece mouthguard composed of a soft cushioning material which provides effective protection and which is so economical to produce, it could be utilized as a one use, sanitary disposable device.

SUMMARY OF THE INVENTION

In order to meet the needs in the art described above, a customizable dental appliance in the nature of a mouthguard has been devised which is composed of a fine closed-cell irradiation cross-linked polyolefin foam. The mouthguard includes two sections, a vertical component and a horizontal component. The foam is molded into a configuration such that the vertical component curves around the anterior section of the maxillary dental arch to the lateral aspects, just beyond the canine teeth. At the mouth temperature of 98.6 degrees F., the vertical component is held perfectly between the upper lip and teeth by the general pressure of lip musculature. There is a V-shaped notch in the midline of the vertical section to accommodate the maxillary labial frenum. The horizontal component provides a bite platform and a slit is located along the midline forming two rearwardly extending tabs to facilitate the curvature of the bite platform. Accommodative curvature of the vertical section is provided by spaces between the horizontal component and the ends of the vertical component forming deflectable wings in these regions.

The molded foam mouthguard of the invention is extremely inexpensive to produce and therefore may be produced in various sizes. Further adjustment may be made in the extent of the margins by cutting away material with common household scissors to accommodate the vast variations that exist in the anatomical form of the human mouth. Such adaptive qualities can be particularly beneficial. The mouthguard includes a vertical section which rests in front of the upper anterior teeth so that aspiration of the appliance farther into the mouth would be highly unlikely. Overall the device is large enough that it would not become an aspiration or swallowing hazard in the case of a traumatic episode.

Other uses and advantages of the present invention will be apparent to those of skill in the art from the following drawings and description of the preferred embodiment, and it will be appreciated by those of skill in the art that the objects of the invention have been achieved. While the present invention will be described with the reference to a specific embodiment, the following description is illustrative of the invention and is not to be construed as limiting the invention. Various modifications to the present invention can be made to the preferred embodiment by those skilled in the art without departing from the true spirit and scope of the invention. It will be noted here that for better understanding like components are designated by the reference numerals throughout the various figures of drawing which follow.

DESCRIPTION OF THE PREFERRED EMBODIMENT

Figure 1:
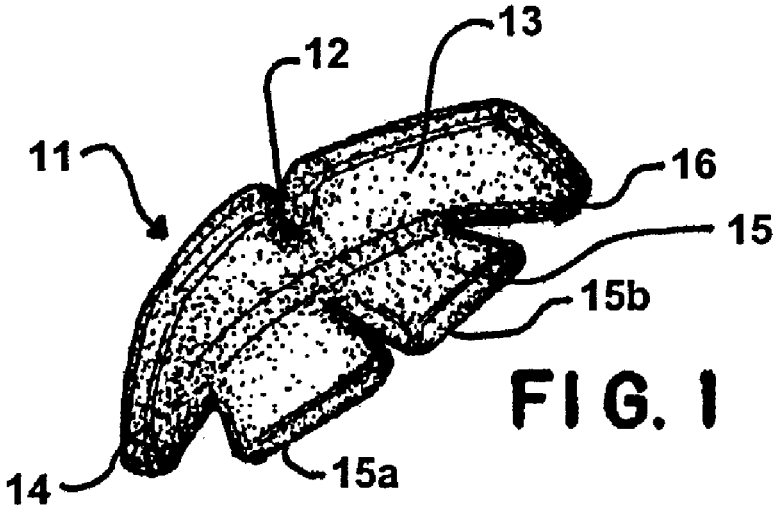
FIG. 1 is a top right rear isometric view of the mouthguard of the invention.
Figure 2:
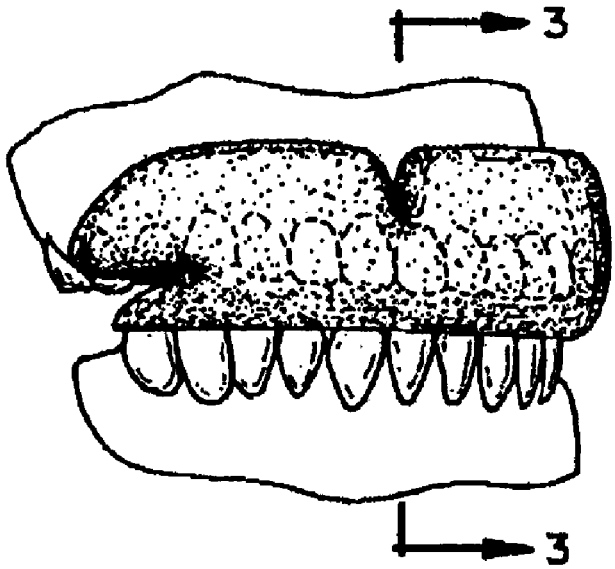
FIG. 2 is a left front elevation view with the mouthguard of the invention shown in position as worn.

As shown in FIG. 1, the mouthguard of the invention 11 is molded in one piece preferably composed of polyolefin foam such as the foam material manufactured by the Voltek company under the product name Volara®. It includes two sections, a vertical component 13 and a horizontal component 15. The horizontal component comprises two rearwardly extending tabs 15*a* and 15*b* that form a bite platform. The vertical component also has a V-shaped midline notch 12 to accommodate the labial frenum and further includes rearwardly extending wings 14 and 16 that are located adjacent to the side edges of each of the bite platform tabs. The flexibility of the foam material and the construction of the mouthguard as shown in FIG. 1 provides it with the flexibility to conform to the individual anatomical shape of the user's mouth as shown in FIG. 2 and as further described in FIG. 3.

Figure 3:
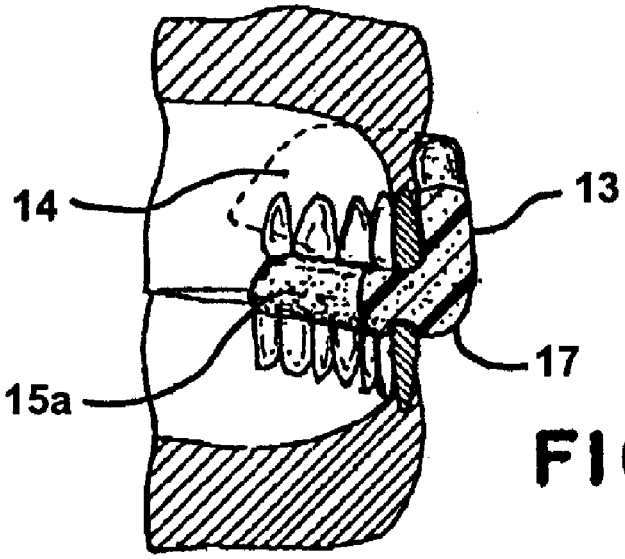
FIG. 3 is a right side partial sectional view taken from FIG. 2 as shown in that figure.

Referring now to FIG. 3, the vertical component 13 of the mouthguard forms an acute angle with the horizontal component 15 which forms a bite platform when worn which lies in the bite plane between all upper and lower anterior teeth at all points along the anterior dental arch. The wing portions (14 shown in phantom) cover the anterior section of the maxillary arch and extends over the lateral aspects beyond the canine teeth as shown in this figure. Since the mandibular teeth bite into the soft material and an elbow portion 17 of the mouthguard extends slightly downward, some frontal protection for the top portions of the mandibular teeth is also provided.

Not only does the mouthguard of the invention provide the advantages of economy, adaptability and simplicity, but also it can be radiation sterilized. Furthermore, it does not break down in human saliva and the foam material of which it is constructed can be adapted to orthodontic hardware unlike harder unyielding mouthguards which are composed of vinyl. Other advantages will be apparent to those of skill in the art without departing from the spirit and scope of the invention. It should be understood that there may be other modifications and changes to the present invention that will be obvious to those of skill in the art from the foregoing description, however, the present invention should be limited only by the following claims and their legal equivalents.

What is claimed is:

1. A mouthguard of one-piece construction, comprising:

a frontally located anterior horizontal bite platform consisting of two rearwardly extending tabs composed only of flexible cushioning material being the same material as the whole mouthguard with a gap between them such that the tabs are adapted to conform to the shape of the user's mouth, said bite platform lying in the bite plane between all upper and lower anterior teeth at all points along the anterior dental arch when said mouthguard is in use; and a curved vertical component for covering the anterior section of the maxillary arch and including a rearwardly extending wing portion on each side of said vertical component which extends rearwardly over the lateral aspects of the arch beyond the bite platform and the canine teeth when worn.

2. The mouthguard of claim 1 wherein bottom edges of said wing portions are spaced from side edges of said bite platform tabs to allow for lateral deflections of the wing portions.

3. The mouthguard of claim 2 further including an elbow portion along the juncture of the vertical component and the horizontal bite platform which extends downward over the top edges of the lower anterior teeth when worn.

4. The mouthguard of claim 3 further including a midline "V" notch located in the middle of the front-facing surface of the vertical component.

5. The mouthguard of claim 4 wherein the mouthguard is composed of polyolefin foam.

6. A mouthguard of one-piece construction, comprising:

a unitary mouthguard for protecting human teeth from injury wholly composed only of a flexible cushioning material formed by molding and including horizontal and vertical portions;

a frontally located anterior horizontal bite platform portion comprising two horizontal rearwardly extending tabs with gap between them such that the lateral position of the tabs is deflectable to conform to the shape of the user's mouth when worn, said bite platform lying in the bite plane between all upper and lower anterior teeth at all points along the anterior dental arch when said mouthguard is worn; and a curved vertical portion covering the anterior section of the user's maxillary arch when worn and including rearwardly extending wing portions on each side of said vertical component which extend rearwardly over the lateral aspects of the arch beyond the bite platform and the canine teeth.

7. The mouthguard of claim 6 wherein bottom edges of said wing portions are spaced from side edges of said bite platform tabs to allow for lateral deflections of the wing portions when worn.

8. The mouthguard of claim 7 further including an elbow portion which extends downward over the top edges of the lower anterior teeth when worn said elbow portion being located along the juncture of the vertical component and the horizontal bite platform.

9. The mouthguard of claim 6 wherein said mouthguard is entirely intra-oral when worn.

* * * * *